US011156368B2

(12) United States Patent
Lambertson

(10) Patent No.: US 11,156,368 B2
(45) Date of Patent: Oct. 26, 2021

(54) RANGE EXHAUST HOOD CLEANING SYSTEM

(71) Applicant: Streivor, Inc., Livermore, CA (US)

(72) Inventor: Jeffrey S. Lambertson, Danville, CA (US)

(73) Assignee: Steivor, Inc., Livermore, CA (US)

( * ) Notice: Subject to any disclaimer, the term of this patent is extended or adjusted under 35 U.S.C. 154(b) by 71 days.

(21) Appl. No.: 16/389,801

(22) Filed: Apr. 19, 2019

(65) Prior Publication Data

US 2019/0390859 A1 Dec. 26, 2019

Related U.S. Application Data

(60) Provisional application No. 62/660,151, filed on Apr. 19, 2018.

(51) Int. Cl.
*F24C 15/20* (2006.01)
*A62C 3/00* (2006.01)

(52) U.S. Cl.
CPC ..... *F24C 15/2057* (2013.01); *A62C 3/006* (2013.01)

(58) Field of Classification Search
CPC ..... F24C 15/2057; F24C 15/20; A62C 3/006
See application file for complete search history.

(56) References Cited

U.S. PATENT DOCUMENTS 3,055,285 A * 9/1962 Gaylord ..... F24C 15/20 126/299 E
3,324,629 A * 6/1967 Graswich ..... F24C 15/20 95/150
3,616,744 A * 11/1971 Jensen ..... F24C 15/20 126/299 E
3,786,739 A * 1/1974 Wright ..... F24C 15/2057 126/299 E
4,022,118 A * 5/1977 Vandas ..... F24C 15/20 126/299 E
4,071,019 A * 1/1978 King ..... F24C 15/2057 126/299 E
4,085,735 A * 4/1978 Kaufman ..... B01D 47/06 126/299 E
4,186,727 A * 2/1980 Kaufman ..... B01D 47/06 126/299 D
4,231,769 A * 11/1980 Ahlrich ..... B01D 50/00 126/299 E
4,363,642 A * 12/1982 Stahl ..... F24C 15/20 126/299 E
6,274,375 B1 * 8/2001 McMinn, Jr. ..... B05B 3/06 210/167.3

(Continued)

*Primary Examiner* — David J Laux
(74) *Attorney, Agent, or Firm* — Kilpatrick Townsend & Stockton LLP

(57) ABSTRACT

An exhaust hood cleaning system for commercial kitchen installations, having a wash control cabinet connected to one or more exhaust hoods over cooking appliance ranges, where each exhaust hood includes a spraying array subsystem within the exhaust hood and a fogging subsystem within the connected flue for the exhaust hood. The exhaust hood cleaning system is electronically controlled, receiving input instructions from any one or combination of an operator interface, fire suppression systems of the building in which the system is installed, and environmental control systems of the building in which the system is installed.

9 Claims, 9 Drawing Sheets

(56) References Cited

U.S. PATENT DOCUMENTS

| | | | | |
|---|---|---|---|---|
| 7,832,391 | B2 * | 11/2010 | Kellogg | F24C 15/2057 126/299 E |
| 7,963,282 | B2 * | 6/2011 | Griffin | A62C 3/006 126/299 E |
| 8,746,231 | B2 * | 6/2014 | Kellogg | F24C 15/2057 126/299 E |
| 10,195,470 | B2 * | 2/2019 | Livchak | A62C 3/006 |

* cited by examiner

RANGE EXHAUST HOOD CLEANING SYSTEM

CROSS-REFERENCES TO RELATED APPLICATIONS

The present application is a Non-Provisional application, which claims the benefit of priority to U.S. Provisional Application No. 62/660,151 filed Apr. 19, 2018, which is incorporated by reference herein in its entirety.

TECHNICAL FIELD

The present invention relates to a cleaning system constructed within an exhaust hood, and in particular within appliances for commercial kitchen installations.

BACKGROUND

In a typical restaurant kitchen, a plurality of cooking appliances are lined up side by side in a row under a common exhaust hood. The cooking units may include, for example, ranges, griddles, fryers, and broilers. The cooking processes performed on such appliances all produce air laden with grease, smoke, fumes, moisture, heat, and other particles in varying amounts and temperatures that coalesces into a thermal plume. A hood is typically positioned above the cooking appliances to capture and contain a mixture of clean and dirty emissions that coalesce into a thermal plume, where an exhaust fan can then draw the thermal plume out of the hood, often through a grease extraction device, where it is filtered.

Generally, hoods that are used to vent commercial cooking appliances that produce grease and/or smoke are referred to as Type I (or "Type 1") hoods, and hoods that are used to vent only heat and water vapor (and not grease or smoke) are referred to as Type II (or "Type 2") hoods. The Type I hood is engineered to capture, contain, filter, and exhaust the mass of burned and unburned gases, as well as the cooking effluents such as grease and water vapor, generated during the cooking process that coalesce to form a thermal plume. National building and fire codes and standard generally require that a Type I Commercial Kitchen Ventilation Hood System be installed over cooking appliances that produce grease laden vapors. These codes and standards, such as the National Fire Protection Associates (NFPA) Standard 96, require that all hoods used in commercial cooking establishments installed over cooking appliances that create effluents other than heat and steam (e.g., grease) during the cooking process include grease removal devices. Such grease removal devices are further individually listed in accordance with Underwriters Laboratories (UL) Standard 1046, or as components of UL 710 listed hoods. This further standard requires grease removal devices to be able to prevent the spread of fire from the upstream face of the filter to an area downstream of the filter, and the filter demonstrates that four times more grease drains from the filter than the amount of grease that collects on the filter during the test.

Traditionally, cleaning the interior surfaces of a hood is a challenging or time-consuming endeavor. Some approaches require taking the front covers off of all the hoods over a range, a manually intensive process, taking all of the affected ranges out of service for the duration of cleaning, and at risk of misaligned reassembly by non-specialized operators (e.g., kitchen staff).

Other approaches have attempted to use a permanently installed static spraying system to clean the exhaust hood, and optionally a flue connected to the hood. U.S. Pat. No. 7,832,391 to Kellogg et al. discloses a system with a fluid spray conduit having set arrangements of spray openings running along the length of an exhaust hood and up the length of a flue. This system, however, and others like it, fail to completely or adequately cover the surface area of the exhaust hood, leading to incomplete cleanings. Further, the volume of water and other fluids used by such methods risk partially flooding the bottom of the exhaust hood, in which case even if the fluids are sufficiently drained, there is an increased risk of spreading grease and particulate matter residue across the full width of the exhaust hood.

There remains an unmet need to provide for an exhaust hood and flue cleaning system that can efficiently, thoroughly, and economically clean all of the necessary interior surfaces of an exhaust hood and flue.

BRIEF SUMMARY

The present disclosure is directed toward an exhaust hood cleaning system efficiently cleaning grease and various cooking plume effluent from cooking exhaust hoods. The system of the present disclosure can manage the cleaning of several exhaust hoods over a variety of commercial kitchen appliances, using sprayed water, fog, or a combination thereof.

As used herein, the term "cooking plume" generally refers to (but is not limited to) grease-laden and/or smoke-laden emissions generated during the cooking process. The cooking plume emissions tend to generate humidity and to have strong odors, in addition to carrying the heat of cooking. Cooking emissions, due to their heat, humidity, odor, and generally unclean character, will tend to cause the build-up of grease and residue in even the most robust of traditional exhaust fans and hoods.

Exemplary embodiments of present system include an exhaust hood cleaning system having: a wash cabinet in fluid communication with a hot water source and a cold water source, the wash cabinet further having a detergent injection system; an exhaust hood having a spraying array subsystem, where the spraying array subsystem includes a fluid conveyor mounted along the length of the exhaust hood and a motor arranged to rotate the fluid conveyor, and where the fluid conveyor has a plurality of nozzles, and where the spraying array subsystem is in fluid communication with the wash cabinet; a ventilation duct having a fogging subsystem in fluid communication with the wash cabinet, having one or more misting nozzles; and a computer-enabled control system configured to control the flow of fluids from the wash cabinet to the spraying array subsystem and the fogging subsystem.

Further exemplary aspects of the present exhaust hood cleaning system include variations of the fluid conveyor and the rotation of the fluid conveyor. In some aspects, the motor is configured to rotate the fluid conveyor at variable speeds. In particular aspects, the motor is configured to rotate the fluid conveyor at a cycling speed of rotation. In other aspects, the fluid conveyor includes a plurality of nozzles. In specific aspects, the plurality of nozzles can have elliptical openings. In other aspects, the plurality of nozzles can that emit a relatively flat or elliptical cone spray pattern. In further aspects, the plurality of nozzles can be aligned with each other, positioned along a single line (centerline or longitudinal axis) of the fluid conveyor. In some aspects, the plurality of nozzles can be arranged such that cones of sprayed fluid from adjacent nozzles overlap with each other by about 5%-10%.

Other exemplary embodiments of the present exhaust hood cleaning system include sensors in operational and informational communication with the computer-enabled control system. In particular, the exhaust hood cleaning system can further include various sensors located within the exhaust hood and within the ventilation duct, where those sensors communicate with the control system in order to provide measured data regarding the status of the exhaust hood and the ventilation duct to the control system. In specific aspects, these sensors can include, but are not limited to, temperature/thermal sensors, air pressure sensors, water pressure sensors, or a combination thereof. The microprocessor controller of the control system can be a non-transitory computer-readable medium configured to receive and optionally execute any or all of automated, programmed, and user-entered operational instructions. Moreover, the control system can include a remote user interface, in electronic communication with the controller, configured to display output data regarding the heat exchange system, and further configured to receive and relay input instructions to the controller to operate and control the heat exchange system. The controller of the control system can be electronic communication with either or both of pressure sensors and thermal sensors in the exhaust hood cleaning system.

Further exemplary embodiments of the present exhaust hood cleaning system are applied to a plurality of exhaust hoods all being in fluid communication with a wash cabinet, and accordingly, all being controlled by the control system. More specifically, such embodiments of present system include an exhaust hood cleaning system having: a wash cabinet in fluid communication with a hot water source and a cold water source, having a detergent injection system; two or more exhaust hood assemblies, where each exhaust hood assembly includes an exhaust hood having a spraying array subsystem, where the spraying array subsystem is in fluid communication with the wash cabinet as well as a fogging subsystem in fluid communication with the wash cabinet; and a computer-enabled control system configured to control the flow of fluids from the wash cabinet each respective spraying array subsystem and fogging subsystem of the two or more exhaust hood assemblies. In such aspects, each exhaust hood assembly of the exhaust hood cleaning system can further include sensors located within the respective exhaust hoods and the respective ventilation ducts, where those sensors are in operational communication with the control system and are configured to provide measured data to the control system. In some aspects, the sensors with in each exhaust hood assembly can include, but are not limited to, temperature/thermal sensors, air pressure sensors, water pressure sensors, or a combination thereof In addition to the exemplary aspects and embodiments described above, further aspects and embodiments will become apparent by reference to the figures and by study of the following detailed description.

BRIEF DESCRIPTION OF THE DRAWINGS

Illustrative aspects of the present disclosure are described in detail below with reference to the following drawing figures. It is intended that that embodiments and figures disclosed herein are to be considered illustrative rather than restrictive.

DETAILED DESCRIPTION OF EXEMPLARY EMBODIMENTS

Figure 1:
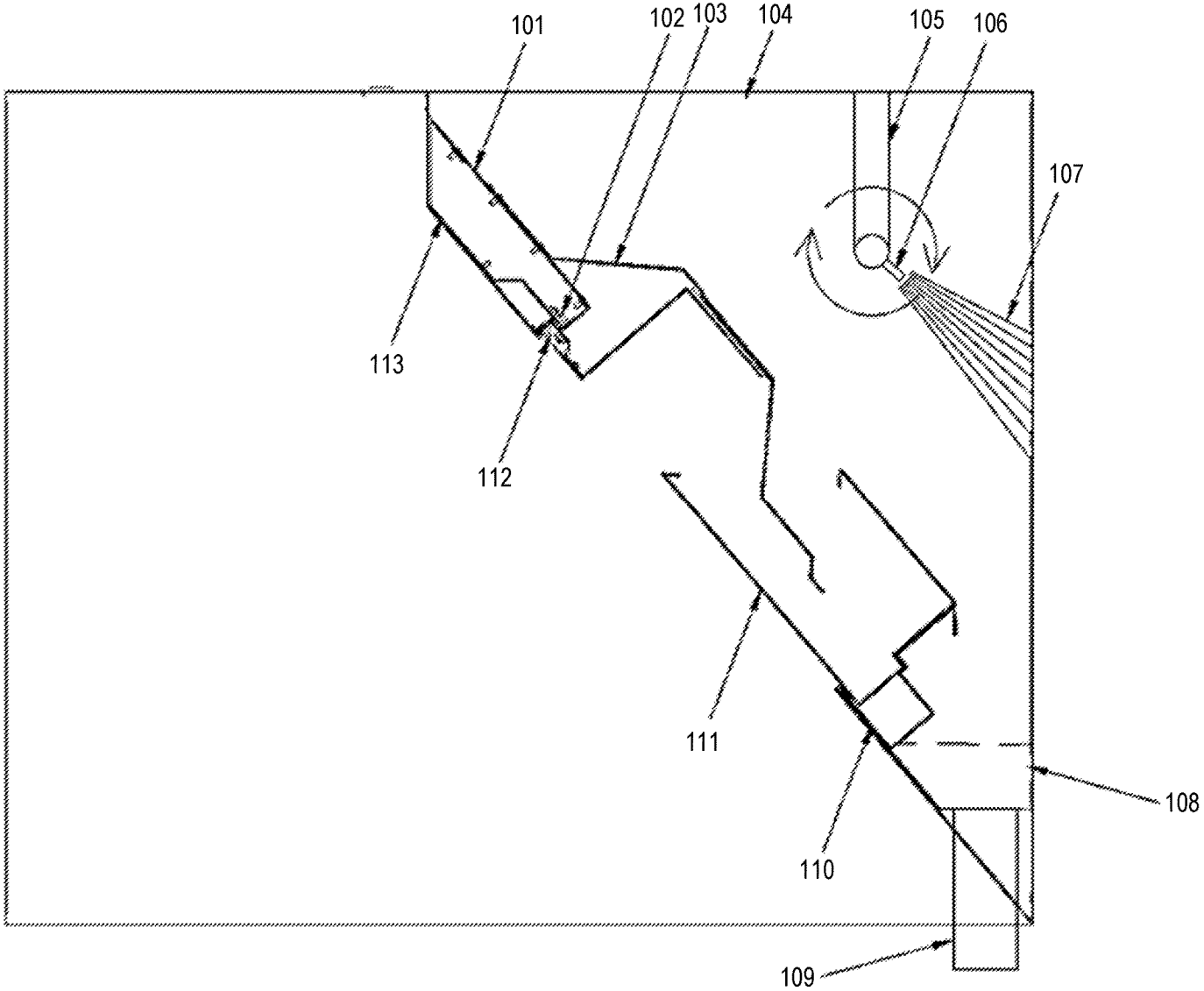
FIG. 1 is a side profile schematic representation of an exhaust hood cleaning system, according to an embodiment of the present disclosure.

Throughout this description for the purposes of explanation, numerous specific details are set forth in order to provide a thorough understanding of the many aspects and embodiments disclosed herein. It will be apparent, however, to one skilled in the art that the many aspects and embodiments may be practiced without some of these specific details. In other instances, known structures and devices are shown in diagram or schematic form to avoid obscuring the underlying principles of the described aspects and embodiments.

Commercial kitchen utilize cooking appliances that operate at very high cooking temperatures. Exemplary appliances include solid fuel or gas char broilers, pizza, and tandoori ovens which are a must to have for commercial kitchens in order to facilitate the cooking processes required to meet the publics food demand requirements. Such relatively high temperature appliances create additional challenges for a commercial kitchen, as compared to traditional appliances medium and low temperature commercial cooking appliances such as ranges, griddle, and ovens. In general, high temperature cooking appliances create more grease and an exhaust plume that is substantially hotter than traditional. The increased grease and higher temperature exhaust plumes place an extra burden on the exhaust hoods, making hood systems that reduce grease accumulation and the temperature of the exhaust plume advantageous.

Commercial kitchen ventilation hoods are required by building codes to ventilate cooking appliances in commercial cooking facilities. Hoods are engineered to capture, contain, filter, and exhaust the cooking plume created during the cooking process. The cooking plume is a mixture of gases, solid fuel creosotes, and/or and particulates released from proteins and other food matter during the cooking process, which mix together to form a collective substance often referred to as grease. The grease created during the cooking process accumulates in and on the inside of the hood canopy, filters, hood exhaust plenum, and exhaust duct as the cooking plume makes its way through the ventilation system. The collection of the grease on the hood exhaust plenum and duct are of particular concern as they are out of sight and often difficult to access for inspection and thorough cleaning. Grease accumulation can result in fire and other health and building issues. Previous attempts have been made to try to reduce the amount of grease accumulation in the hood plenum and duct, as well as attempts to wash out and or eliminate the grease accumulation. One of the most common techniques uses an installation of water nozzle(s) in the hood exhaust plenum, often referred to as a water wash system.

More specifically, national building, fire, and mechanical codes and standards generally mandate that a Type I hood system be installed over commercial cooking appliances that generate grease laden vapors during the cooking process. A typical Type I wall canopy hood requires approximately two hundred fifty cubic feet per minute of exhaust air volume for every linear foot of kitchen hood length (250 CFM/ft.). A twelve foot (12 ft.) long Type I wall canopy hood requires approximately three thousand cubic feet per minute (3,000 CFM) of exhaust air to ventilate a mixed line of cooking appliances. In such a mixed line of cooking appliances, it is typical to have as much as one hundred thirty-two inches (132") of cooking appliance linear length covered by a one hundred forty-four inch (144") hood. Any given mixed line of cooking appliances can include, for example tank fryers, griddles, hot tops, combination ovens, char broilers, pizza ovens, tandoori ovens, and the like.

Generally, the ventilation of a Type I exhaust hood includes a cooking emission exhaust duct is connected to a cooking emission exhaust fan, where the cooking emission exhaust fan draws cooking emissions through the cooking emission exhaust duct away from the Type I hood. These cooking emissions can include the cooking emissions after passing through filter structure, having a fraction of effluents removed from the overall cooking emission flow, thereby being relatively cleaner than initial cooking emissions, but still being substantively unclean and grease laden. Typically, the cooking emission exhaust fan is located on the roof or other exterior surface of a building in which the kitchen appliances are located. More specifically, as the cooking emissions rise up from the kitchen appliances into the plenum of the Type I hood, the draw generated by the cooking emission exhaust fan pulls the cooking emissions through the filter structure. In addition to the cooking emissions, ambient air from the interior environment (i.e. the kitchen) is also drawn into the Type I hood plenum and mixes with the cooking emissions as the air passes through the filter structure and out of the building through the cooking emission exhaust duct and cooking emission exhaust fan.

The current wash systems used in such exhaust hoods typically convey water and detergents to nozzle(s) placed in fixed "strategic" places throughout the plenum in an effort to spray areas that are most impacted by the grease accumulation. Other wash systems use fixed "overlapping" nozzle cone patterns spaced throughout the exhaust hood plenum in an attempt to have the fluid communicate with the entire plenum. Both of these known wash systems have severe deficiencies.

The strategic wash system designs are limited in that such systems are only able to clean the area of the plenum that the fluids communicate with. Specifically, the nozzle design of a strategic wash system will only communicate with the plenum area that is directly in front of the nozzle. Further, a strategic system is limited by nozzle design capabilities, often having an uneven disbursement of the water and detergent fluids within the spray cone of the nozzle. These deficiencies result in areas of the plenum that are in inconsistent or varying degrees of communication with the wash fluids, or not covered by wash fluids at all. The areas of the plenum that are not in communication, or have lesser communication, with the fluids will result in areas of the plenum that are not cleaned, or require excessive amounts of fluids to be supplied to clean the area as compared to an area that is in optimum communication with the fluids.

The overlapping wash system designs generally arrange their nozzles to be positioned in a pattern so that the nozzle cones overlap to form a continuous communication with the plenum. The overlapping design often requires an excessive number of fixed nozzles to be pointed in various directions to create an overlapping pattern that attempts to cover all target surfaces of the exhaust plenum. Exhaust plenums are usually made up of irregular shapes, and thus achieving equal fluid communication with fixed nozzles even if they are overlapping, throughout the plenum is not easily achievable if at all. In addition, each nozzle added to the overlapping system (and any wash system) increases the amount of pressure and volume of fluids that the wash system will need to deliver the nozzle to successfully spray the intended surfaces. Such additional fluid requirements add significant size and cost to the delivery and wasting systems of the wash system. Often the additional pressure and volume required for an overlap system will exceed the available resources of the facility and/or budget of the project.

The present disclosure generally relates to an exhaust hood washing and cleaning system for commercial kitchen cooking appliances that create thermal plumes, where the thermal plumes generally include grease laden air generated during the cooking process. The exhaust hood cleaning system includes a wash cabinet for controlling and routing fluids, an electronic control system for receiving and sending instructions to the wash cabinet, a spraying array subsystem for spraying cleaning fluids within one or more exhaust hoods, and a fogging subsystem for cleaning one or more ventilation ducts (flues) connected to respective exhaust hoods. This exhaust hood cleaning system can be configured to be installed in combination with both a Type I and a Type II commercial kitchen hood.

As used herein, the term "about" is used to provide flexibility to a numerical range endpoint by providing that a given value may be greater than or less than the value. Unless otherwise specified, about modifies a given value by ±10%. Further, the term "subsystem" as used herein refers to a portion or module of the overall exhaust hood cleaning system.

Spraying Array Subsystem

The preset disclosure is directed to a computer controlled, programmable exhaust hood cleaning system (alternatively referred to as a "wash system") that includes a fluid conveyor mounted within the plenum of an exhaust hood, where the fluid conveyor is has a plurality of nozzles fixed to and spaced along the fluid conveyor, and where the fluid conveyor is movable via a motor. In particular, the motor is configured to rotate the fluid conveyor three hundred sixty degrees (360°) about the longitudinal axis of the fluid conveyor, in a clockwise or a counter-clockwise direction, and at varying speeds. The plurality of nozzles are arranged on the fluid conveyor in a pattern such that fluid that is sprayed out of the nozzles form a continuous and overlapping emission. The fluid conveyor itself can be mounted to the top or ceiling of the exhaust hood, with fluid supply pipes leading into the fluid conveyor (which can also be a pipe). The combination of the variable rotation of the fluid conveyor and the nozzle pattern allows the fluid emitted by the wash system to cover effectively the entire exhaust hood plenum area in relatively equal amounts, resulting a thorough cleaning of the plenum and without using excessive volumes of fluids.

The ability to rotate the plurality of nozzles along the fluid conveyor eliminates the deficiency of fixed nozzle system that are only able to communicate fluids in a predetermined spraying cone in front of those nozzles. Indeed, even only one nozzle with the ability to rotate 360° around its axis of rotation can provide unlimited coverage over the range of the its spraying cone. The motor rotating the fluid conveyor can be controlled and programmed to start at specific times or increments, stop at specific times or increments, increase the speed of rotation, decrease the speed of rotation, or have a varying speed of rotation among other operational controls, instructions, and programs. In some implementations, the rotation of the fluid conveyor can be configured to be proportional to the distance of the relative exhaust hood plenum wall the plurality of nozzles are directed towards. In other words, the fluid conveyor can have a cycling speed of rotation. For example, as the fluid conveyor rotates with the plurality of nozzles facing a relatively close wall of the exhaust hood plenum, such as the ceiling of the exhaust hood (e.g., when the fluid conveyor is mounted to the ceiling of the exhaust hood), the fluid conveyor can rotate at a relatively faster rate because the target surface areas will be sufficiently and efficiently cleaned at that relatively fast speed of spray coverage. In contrast, as the fluid conveyor rotates with the plurality of nozzles facing a relatively distant wall of the exhaust hood plenum, such as the bottom of the back wall of the exhaust hood, the fluid conveyor can rotate at a relatively slower rate to ensure that the target surface areas will be sufficiently and efficiently cleaned by the spray coverage. Such a cyclic rotation alternating between faster and slower movement of the fluid conveyor can be achieved, for example where the motor drives the fluid conveyor with an eccentric cam having a variable eccentricity.

The computer-controlled fluid wash conveyor allows for a system design that provides optimum fluid communication with the plenum for thorough cleaning of the entire plenum while delivering the minimum amount of fluids. In various aspects, the wash system control can vary the pressure of the fluid emitted through the plurality of nozzles, the volume of fluid delivered to the fluid conveyor, and the temperature of the fluids. In particular, the wash system control can deliver fluids at varying temperatures to achieve such things as a cold water fogging, a cold water rinse, a warm water wash, and a hot water cold thereby adding to the energy efficiency and operational flexibility of the wash system.

The exhaust hood cleaning system can include temperature sensor, air pressure sensors, or other sensors that detect different states in or around the exhaust hood, communicating those states to the computerized control system. Further, sensors can be located within or proximate to a flue connected to an exhaust hood, or to a ventilation fan drawing or pushing air through the flue (more generally referred to as a ventilation duct). Such sensors located within or proximate to the flue can similarly include temperature sensor, air pressure sensors, or other sensors that detect different states. In response to the sensor readings, the control system of the exhaust hood cleaning system can then proceed with programs or adjustments to ensure that the exhaust hood remains in an operational and functional state and that air flow through the flue adequately ventilates the exhaust hood.

Fogging Subsystem

As noted, high temperature cooking appliances create an exhaust plume that contains hotter temperatures and more grease than standard or traditional commercial cooking applicants. The increased temperature and grease both create challenges that must be addressed to deliver a safe and code compliant hood system. In particular, the high temperature exhaust plume, due to its physics, increases the potential of a fire starting in the hood system.

Municipalities and building owners have been implementing updated codes and restrictions to account for the greater amounts of grease that vent through the building duct systems and out of a building directly into the atmosphere. To meet the code requirements for grease exhaust, a pollution control unit ("PCU"), such as a triple filter system or electrostatic precipitator, is often installed as part of the ventilation system. The PCU can be positioned as part of the ventilation system up within or downstream of an exhaust hood flue. Many PCU have maximum operational temperature limits for the received exhaust plume. Thus, when cooking appliances generate an exhaust plume temperature that exceeds the temperature limit of the PCU, the exhaust plume must be cooled before entering the PCU.

Accordingly, the present disclosure is also directed to a the control of a fogging system that can be used to reduce the temperature of the exhaust plume. The fogging system can take a cold water supply and generate mist upward into a flue, reducing the temperature of the cooking plume within the flue. Similarly to the spraying array subsystem, the fogging subsystem can include temperature sensors, air pressure sensor, or other sensors that detect different states in or around the hood. For instance, if the control system is alerted to a high temperature in the area of the exhaust plenum or ventilation duct area, the control system can initiate a programmed response that turns on the fluid to the fogging system, thereby cooling the flue and/or plenum and exhaust plume passing through the flue and/or plenum.

FIG. 1 is a side profile schematic representation of an exhaust hood cleaning system. FIG. 1 includes switch housing cover 101, magnetic switch 102, upper deflector 103, hood exhaust plenum 104, water wash supply pipe 105, rotating wash nozzle 106, detergent/water spray 107, waste collection zone 108, waste drain 109, pitched grease trough 110, grease extraction filter 111, magnetic switch actuator 112, and switch housing 113. In particular, a hood exhaust plenum 104 is shown with a water washing system comprising hood exhaust plenum 104, water wash supply pipe 105, and rotating wash nozzle 106 where the washing system can also use detergents or other fluids and solutes in addition to water. The intake path of the hood, receiving cooking emissions, includes a grease extraction filter 111 that is latched and removably secured to the hood. The latch can include a magnetically actuated switch 102 and magnetic switch actuator 112 that can hold the grease extraction filter in place. A sensor can be located proximate to the latch, detecting the presence or lack of a filter being mounted in that position. The presence or lack of a filter can be communicated to the control system for the overall exhaust hood cleaning system, to control the operation of a washing cycle. For example, the presence or absence of a filter can be used to prevent the initiation of a wash cycle, depending on a selected washing program or protocol.

The exhaust hood cleaning system includes a fluid conveyor comprising a water wash supply pipe 105 and a rotating wash nozzle 106 (e.g. a pipe with nozzle outlets) that, as shown, is mounted to the ceiling or top of the exhaust hood plenum. In other implementations, the fluid conveyor can be mounted to the back wall of the exhaust hood plenum. The fluid conveyor can be arranged to be generally parallel to the length of the exhaust hood in which it is mounted. Water supply pipes, carrying either or both of hot and cold water, are connected to the fluid conveyor, bringing the interior of the fluid conveyor into fluid communication with a water source. The exhaust hood plenum further includes a pitched grease trough 110 for collecting grease from the grease extraction filter 111, as well as a waste drain for collecting and routing away water (sprayed by the fluid conveyor) from the plenum. The presence of the grease trough in part prevents excess grease from collecting and aggregating within the waste drain which will tend to receive a larger volume of fluids. The fluid conveyor including rotating wash nozzle 106, as mounted to the exhaust hood plenum, is further connected to a motor that drives the fluid conveyor to rotate 360° about its longitudinal axis. Accordingly, when the fluid conveyor is rotated with washing fluid being pumped through the fluid conveyor, the sprayed fluids including detergent/water spray 107 will generally cover all interior surfaces of the exhaust hood plenum with a relatively equal distribution, sufficient to clean the interior of the plenum.

Figure 2A:
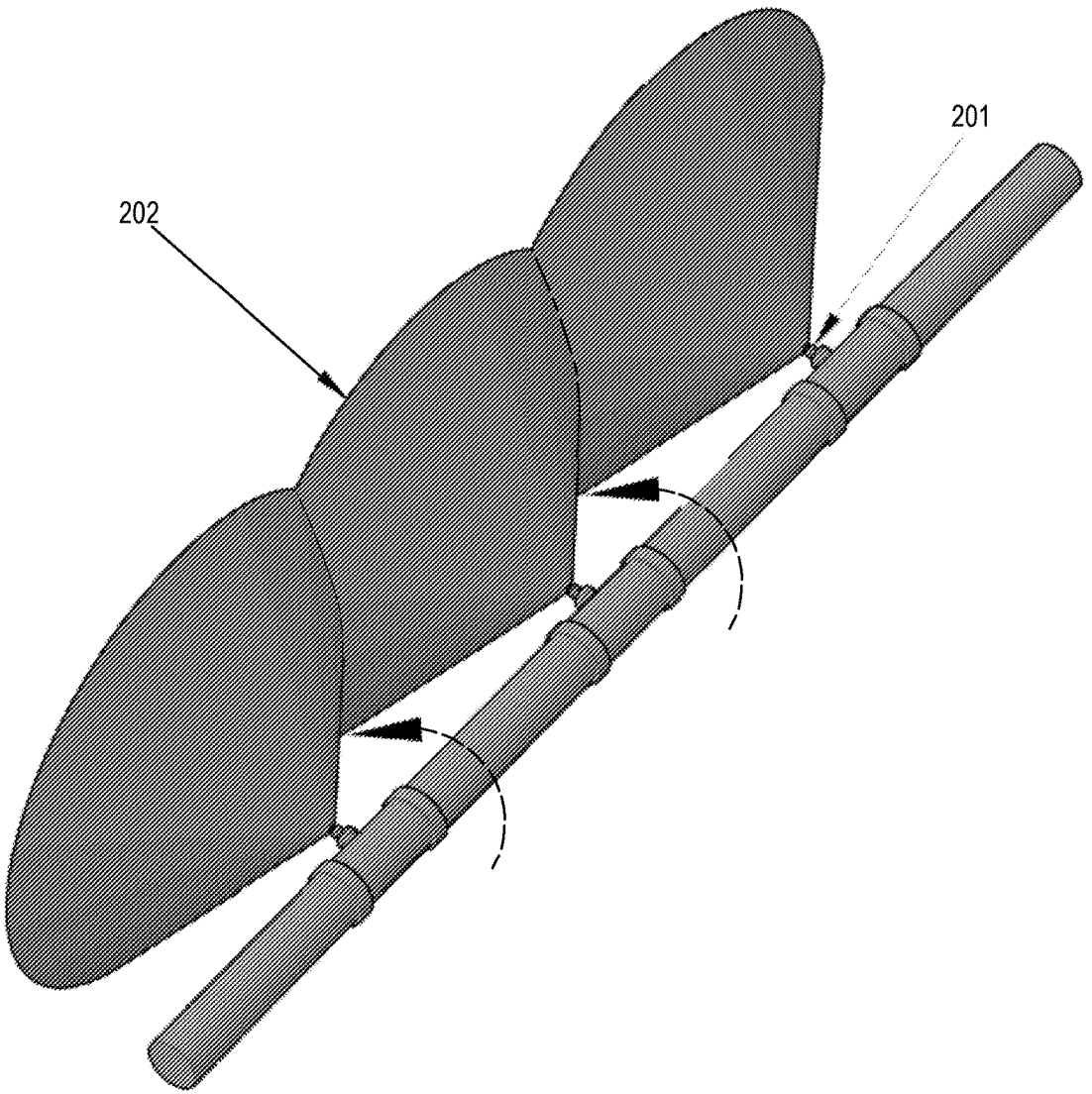
FIG. 2A is an exemplary schematic representation of a first spraying array as part of an exhaust hood cleaning system, according to aspects of the present disclosure.

FIG. 2A is an exemplary schematic representation of a first spraying array as part of an exhaust hood cleaning system. FIG. 2A shows a rotating wash nozzle 201 and overlapping spray pattern 202. Here it can be seen that the fluid conveyor can have a plurality of nozzles that emit a generally circular cone spray pattern, where the end areas of the sprayed cones partially overlap, and that the fluid conveyor can rotate around its longitudinal axis. In some aspects, the overlap of the sprayed cones can be less than 5% about 5%, from 5% to 10%, about 10%, or greater than 10% of the width of each sprayed cone of fluid.

Figure 2B:
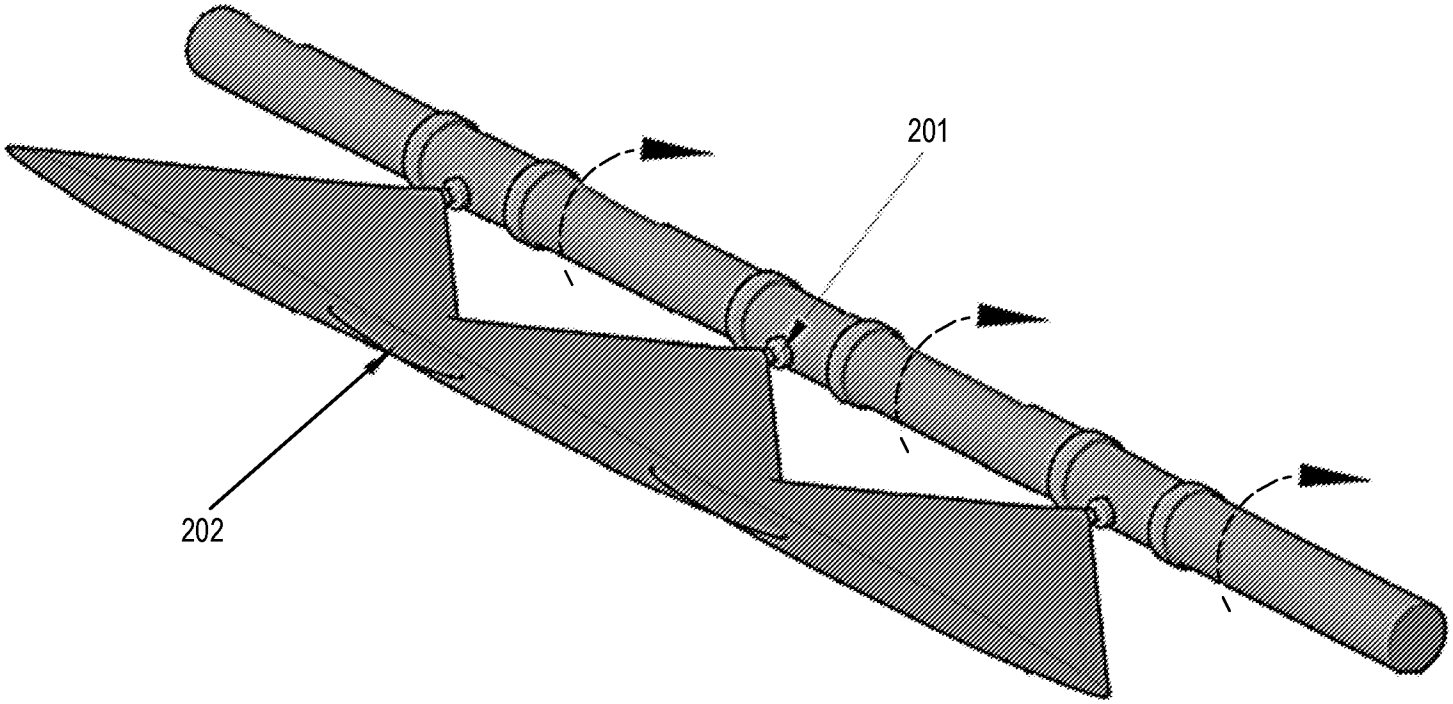
FIG. 2B is an schematic representation of a second spraying array as part of an exhaust hood cleaning system, according to aspects of the present disclosure.

FIG. 2B is an schematic representation of a second spraying array as part of an exhaust hood cleaning system. FIG. 2B shows rotating wash nozzle 201 and overlapping spray pattern 202, with a 12" maximum spacing between nozzles. Here it can be seen that the fluid conveyor can have a plurality of nozzles that emit a relatively flat or elliptical cone spray pattern, where the end areas of the sprayed cones partially overlap and that the fluid conveyor can rotate around its longitudinal axis. In some aspects, the overlap of the sprayed cones can be less than 5% about 5%, from 5% to 10%, about 10%, or greater than 10% of the width of each sprayed cone of fluid.

It should be appreciated that the fluid conveyors shown herein can be mounted and driven to rotate in either a "forward" or "backward" direction (if being viewed head on) or in a "clockwise" "or counter-clockwise" direction (if being viewed end on). Indeed, a given cleaning protocol may control the fluid conveyor to rotate in both directions during the course of the cleaning cycle, or at different or variable speed during the course of the cleaning cycle. In various embodiments, the fluid conveyor mounted within the exhaust hood plenum can rotate at a speed of one rotation per minute to sixty rotations per minute (1 rot/min-60 rot/min), and increments or gradients of speed within that range, or at a cyclically changing speed within that range.

Figure 2C:
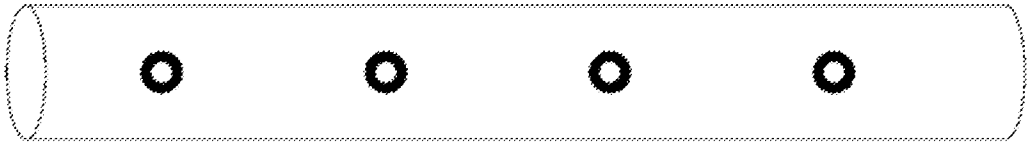
FIG. 2C is an exemplary first arraignment of outlet nozzles for a spraying array, according to aspects of the present disclosure.

FIG. 2C is an exemplary first arraignment of outlet nozzles for a spraying array. In this arrangement, the plurality of nozzles are generally positioned along a single line, in other words aligned with each other, and have circular openings. In one aspect, a fluid conveyor can have a single line of outlet nozzles. In other various aspects, a fluid conveyor can have two lines, three lines, or four lines of such outlet nozzles, forming the plurality of nozzles for the fluid conveyor.

Figure 2D:
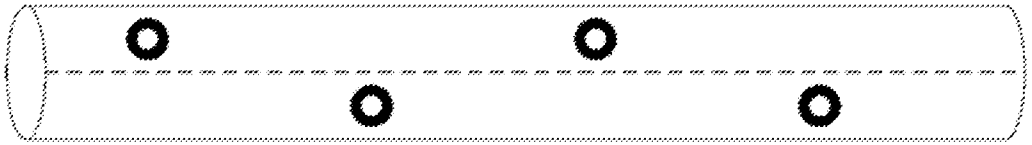
FIG. 2D is an exemplary second arraignment of outlet nozzles for a spraying array, according to aspects of the present disclosure.

FIG. 2D is an exemplary second arraignment of outlet nozzles for a spraying array. In this arrangement, the plurality of nozzles are generally positioned staggered relative to each other, alternating along either side of a centerline, and have circular openings. In one aspect, the outlet nozzles can be equidistant from the relative centerline. In other various aspects, the nozzles can be staggered according to a pattern that has more than two positions relative to the centerline. In other aspects, the nozzles can have openings of an elliptical or other (non-circular) shape.

Figure 2E:
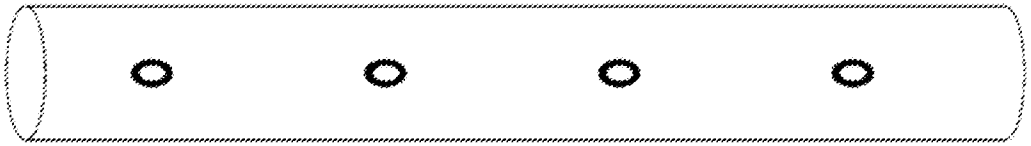
FIG. 2E is an exemplary third arraignment of outlet nozzles for a spraying array, according to aspects of the present disclosure.

FIG. 2E is an exemplary third arraignment of outlet nozzles for a spraying array. In this arrangement, the plurality of nozzles are generally positioned along a single line, in other words aligned with each other, and have elliptical openings. In one aspect, a fluid conveyor can have a single line of outlet nozzles. In other various aspects, a fluid conveyor can have two lines, three lines, or four lines of such outlet nozzles, forming the plurality of nozzles for the fluid conveyor.

Figure 2F:
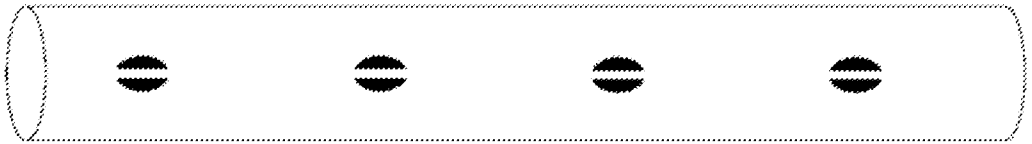
FIG. 2F is an exemplary fourth arraignment of outlet nozzles for a spraying array, according to aspects of the present disclosure.

FIG. 2F is an exemplary fourth arraignment of outlet nozzles for a spraying array. In this arrangement, the plurality of nozzles are generally positioned along a single line, in other words aligned with each other, and have slotted (generally flat) openings. In one aspect, a fluid conveyor can have a single line of outlet nozzles. In other various aspects, a fluid conveyor can have two lines, three lines, or four lines of such outlet nozzles, forming the plurality of nozzles for the fluid conveyor.

It should be appreciated that each nozzle of the plurality of nozzles on a fluid conveyor can be arranged to provide for a specific area of coverage and distance of spray cone. It should be further appreciated that the distance between each nozzle of the plurality of nozzles on a fluid conveyor can be configured to provide for a specific degree of overlap between the spray cones emitted from each nozzle at the distances the spray cones reach a surface to be cleaned. In some aspects, the nozzles along a fluid conveyor are spaced an equal distance away from each other, and in particular about twelve inches (12 in.) distant from each other. In various other aspects, the nozzles are spaced about fifteen inches (15 in.), about eighteen inches (18 in.), about twenty-one inches (21 in.), or about twenty-four inches (24 in.) equidistant away from each other. In other aspects, the nozzles are spaced apart from each other at various lengths away from each other, the length between each nozzle varying from about six inches (6 in.) to about twenty-four inches (24 in.).

Figure 3A:
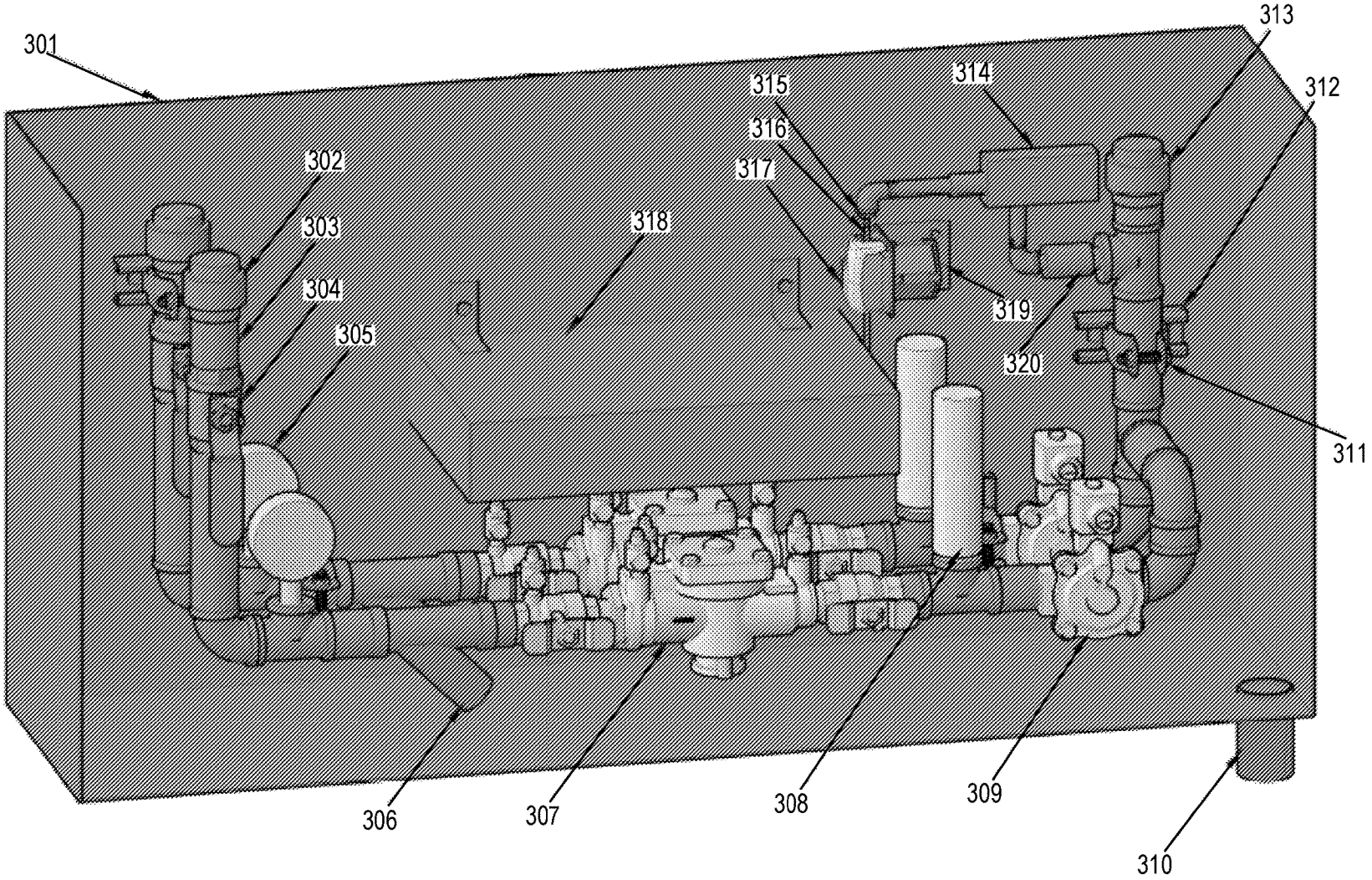
FIG. 3A is a schematic illustration of a wash cabinet used as part of the exhaust hood cleaning system, according to aspects of the present disclosure.

FIG. 3A is a schematic illustration of a wash cabinet used as part of the exhaust hood cleaning system. FIG. 3A shows a water was cabinet 301, a union (supply inlet) 302, a brass nipple 303, a ball valve 304, a pressure and/or temperature gauge 305, a wye strainer 306, a backflow preventer 307, a water hammer arrestor 308, a solenoid valve 309, a cabinet drain 310, a pipe clamp 311, a unistrut 312, a union (wash outlet to hood) 313, an (optional) detergent flow switch 314, a barbed tube fitting 315, a detergent tubing 316, a variable speed detergent pump 317, a detergent reservoir 318, a detergent pump bracket 319, and a detergent check valve 320. The wash cabinet is connected to the overall exhaust hood cleaning system, having fluidic connections comprising union 302 to both hot water and cold water sources (shown in parallel on right side of figure), outlets comprising union 313 for both hot water and cold water to one or more exhaust hoods that are part of the overall system, and operational connections to a computerized control system that controls the valves comprising solenoid valve 309 and thereby the routing of fluids through the wash cabinet to the one or more exhaust hoods connected to the wash cabinet. The wash cabinet can be said to be in "fluid communication" with both hot water and cold water sources, and also in fluid communication with the spraying array subsystem and the fogging subsystem, to indicate that water and other fluids flow to and through the wash cabinet, spraying array subsystem, the fogging subsystem.

As shown, the wash cabinet includes two supply inlets for water (e.g., for hot water and cold water sources), each having a ball valve as well as a pressure and/or temperature gauge. The pressure and/or temperature gauge can further be a sensor that send water pressure and water temperature reads to the computerized control system, to allow for further modification and control. Each inlet is further coupled in line to a wye strainer, a backflow preventer, and a water hammer, providing for fluid control and structure to prevent fluids from moving backward through the system in an undesired manner. Each inlet further connected to a solenoid valve, configured to control the flow of fluid from the respective inlet to the downstream exhaust hood washing systems.

Past the solenoid valves, the two sources of fluid are joined at a single pipe within the wash cabinet. At this junction, a detergent reservoir, a variable speed detergent pump, an optional detergent flow switch, and a detergent check valve are connected to each other to feed into the joined stream of fluid. These components providing detergent into the stream of fluid within the wash cabinet can be referred to as a detergent injection system. Accordingly, through the controlled wash cabinet, either or both of hot and cold water can be received from source flows, the volume of the flows can be regulated to form an outlet flow, detergent can be added to the outlet flow, and the outlet flow proceeds to be routed to one or more exhaust hood wash systems downstream.

Figure 3C:
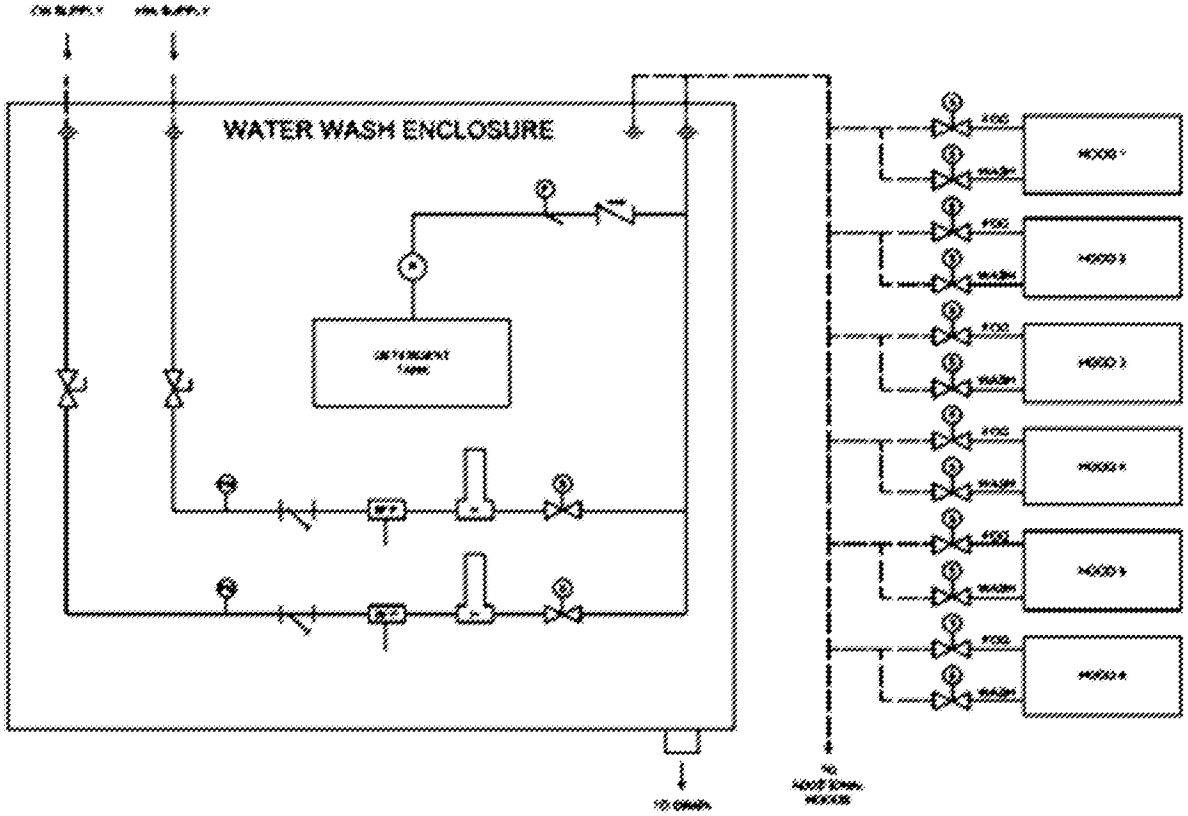
FIGS. 3B and 3C show a schematic symbol key and a schematic piping and instrumentation diagram of a flow system for an exhaust hood cleaning system, according to aspects of the present disclosure.
Figure 3B:
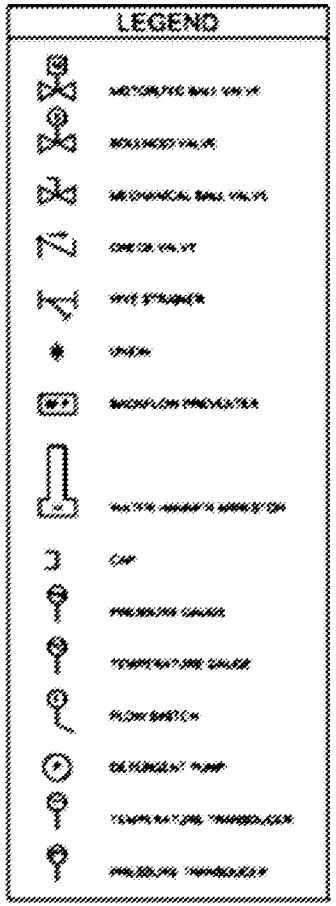

FIGS. 3B and 3C show a schematic symbol key and a schematic piping and instrumentation diagram ("P&ID") of a flow system for an exhaust hood cleaning system. Specifically, FIG. 3B shows symbols for motorized valves, solenoid valves, mechanical ball valves, check valves, wye strainers, unions, backflow preventers, water hammer arrestors, caps, pressure gauges, temperature gauges, flow switches, detergent pumps, temperature transducers, and pressure transducers, included in the schematic of FIG. 3B. The flow system schematic further illustrates the components of the wash cabinet as seen in FIG. 3A in P&ID format. Moreover, the P&ID shows the capability of the wash cabinet to connect to multiple exhaust hoods, and to provide fluid to both fogging subsystems and spray array subsystems in each exhaust hood. In this context, each individual pairing of an exhaust hood and ventilation duct (or flue) can be referred to as an exhaust hood assembly. Accordingly, it should be understood that the present exhaust hood cleaning system can manage the cleaning cycles of multiple hoods over corresponding cooking appliances in a commercial kitchen.

It can be appreciated that the selection and direction of hot water or cold water can be tailored to the functionality of different parts of the exhaust hood cleaning system. For example, hot water tends to help activate detergent, and accordingly the wash cabinet can be configured to use and direct hot water, adding detergent to that hot water, to a spraying array subsystem for cleaning the exhaust hood plenum. On the other hand, where the objective of providing fog into a flue is to cool the flue down to a target or operational temperature, the wash cabinet can be configured to use and direct cold water to the fogging subsystem such that misting nozzles generate a cooling fog (and not steam).

Figure 4A:
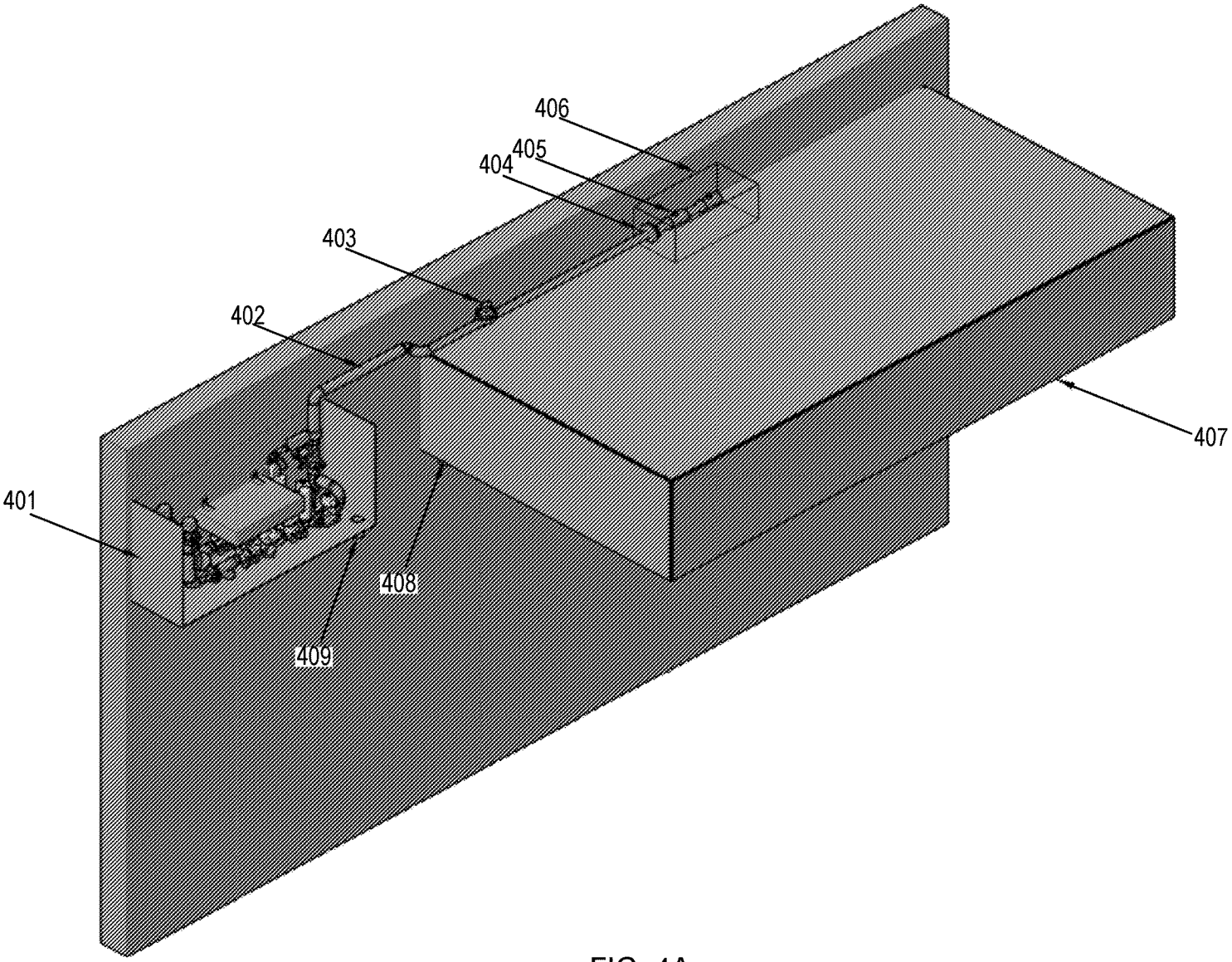
FIG. 4A is a schematic illustration a wash cabinet as connected to a fogging subsystem of the exhaust hood cleaning system, according to aspects of the present disclosure.

FIG. 4A is a schematic illustration a wash cabinet as connected to a fogging subsystem of the exhaust hood cleaning system. FIG. 4A shows a fog cabinet 401, field installed piping 402, a fog solenoid 403, a UL listed hood penetration seal 404, a fog nozzle 405, a hood collar 406, a hood 407, a hood drain 408, and a cabinet drain 409. In particular, a fog cabinet (rendered as transparent) is in fluid communication with the wash cabinet via piping. The fog cabinet is mounted on top of the exhaust hood, and is open to a flue (not shown) of the exhaust hood. In some aspects, the fog cabinet can be arranged in line with or as part of the flue. A solenoid valve is located between the wash cabinet and the fog cabinet to control the timing and flow of fluid to the misting nozzles connected to the end region of the piping within the fog cabinet. Mist is emitted from the misting nozzles and is propagated or drawn (e.g., by a ventilation fan) into the flue. The fog emitted from the misting nozzles can thereby cool the temperature of the exhaust plume within the flue. In some aspects, the fog emitted from the misting nozzles can also be directed downward into the exhaust hood to cool the air and exhaust plume within the plenum of the exhaust hood. The fog cabinet and the flue can include various sensors, such as temperature sensors, air pressure sensors, and water pressure sensors, that are in electronic communication with the control system. The control system can follow protocols to generate fog on-demand in response to user-entered instructions, on a timed cycle, automatically in response to a trigger (e.g., from a temperature sensor detecting a temperature above a set threshold), or a combination thereof.

Figure 4B:
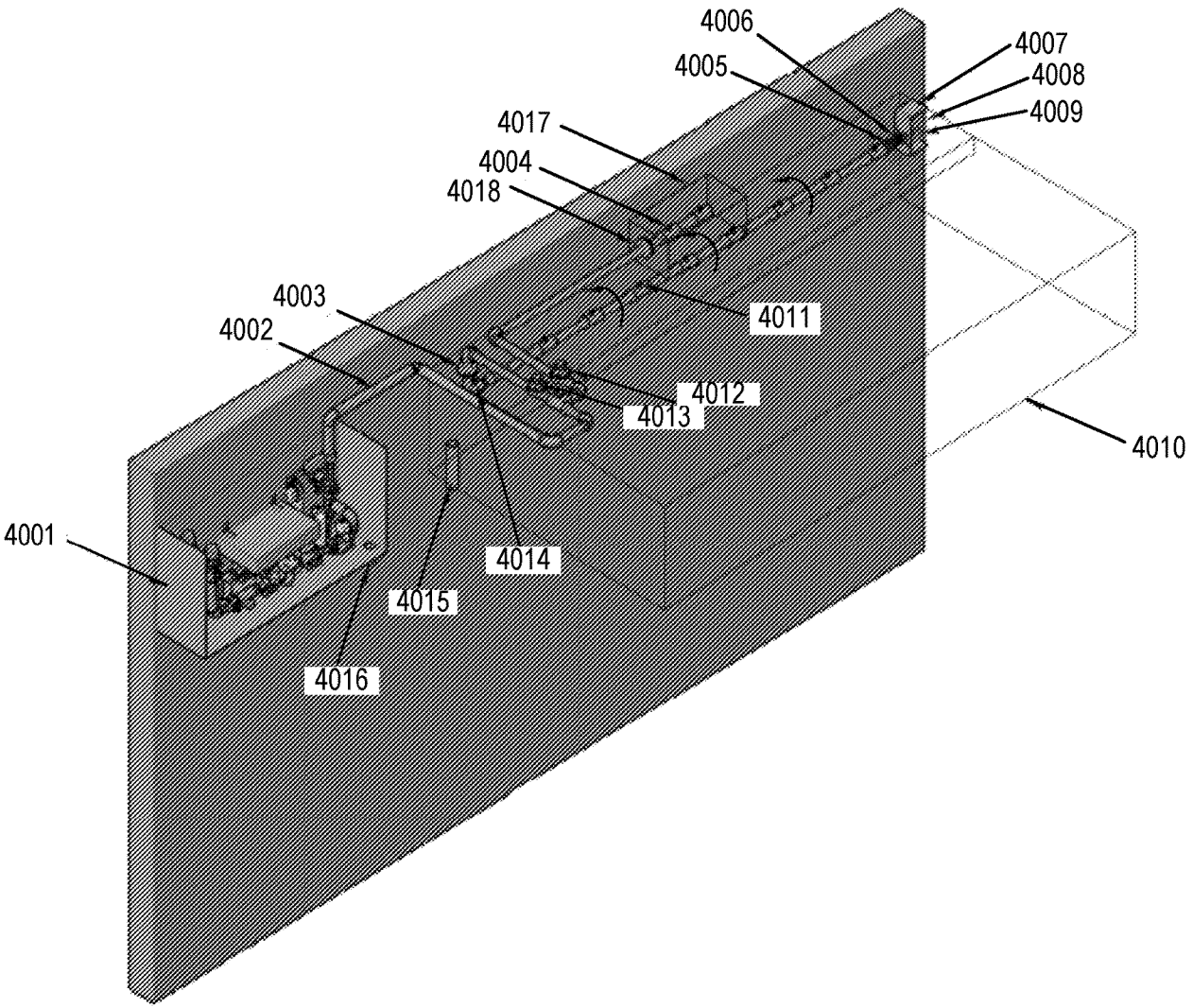
FIG. 4B is a schematic illustration a wash cabinet as connected to a spraying subsystem of the exhaust hood cleaning system, according to aspects of the present disclosure.

FIG. 4B is a schematic illustration a wash cabinet as connected to a spraying subsystem of the exhaust hood cleaning system (the exhaust hood rendered as transparent). FIG. 4B shows a water wash cabinet 4001, field installed piping 4002, UL listed hood penetration seal 4003, fog nozzle 4004, sleeve bearing 4005, shaft coupling 4006, motor bracket 4007, motor enclosure 4008, motor 4009, hood 4010, rotating wash nozzle 4011, fog solenoid valve 4012, wash solenoid valve 4013, rotary union 4014, hood drain 4015, water wash cabinet drain 4016, hood collar 4017, and UL listed hood penetration seal 4018. In particular, the fluid conveyor mounted within the exhaust hood plenum is in fluid communication with the wash cabinet via piping. The fluid conveyor is mounted an interior surface of the exhaust hood, and is further mounted to a motor positioned at one end of the exhaust hood. The motor is enclosed to be protected from the environment of the exhaust hood, and is arranged to rotate the fluid conveyor along its longitudinal axis. The fluid conveyor has a plurality of nozzles through which cleaning fluids from the wash cabinet (e.g., water, detergent, or a combination thereof) is sprayed into the plenum of the exhaust hood. The exhaust hood further includes a hood drain to direct away fluid runoff from the cleaning cycles. The control system can follow protocols to start a spraying process on-demand in response to user-entered instructions, on a timed cycle, automatically in response to a trigger (e.g., from a temperature sensor detecting a temperature above a set threshold), or a combination thereof.

Figure 5:
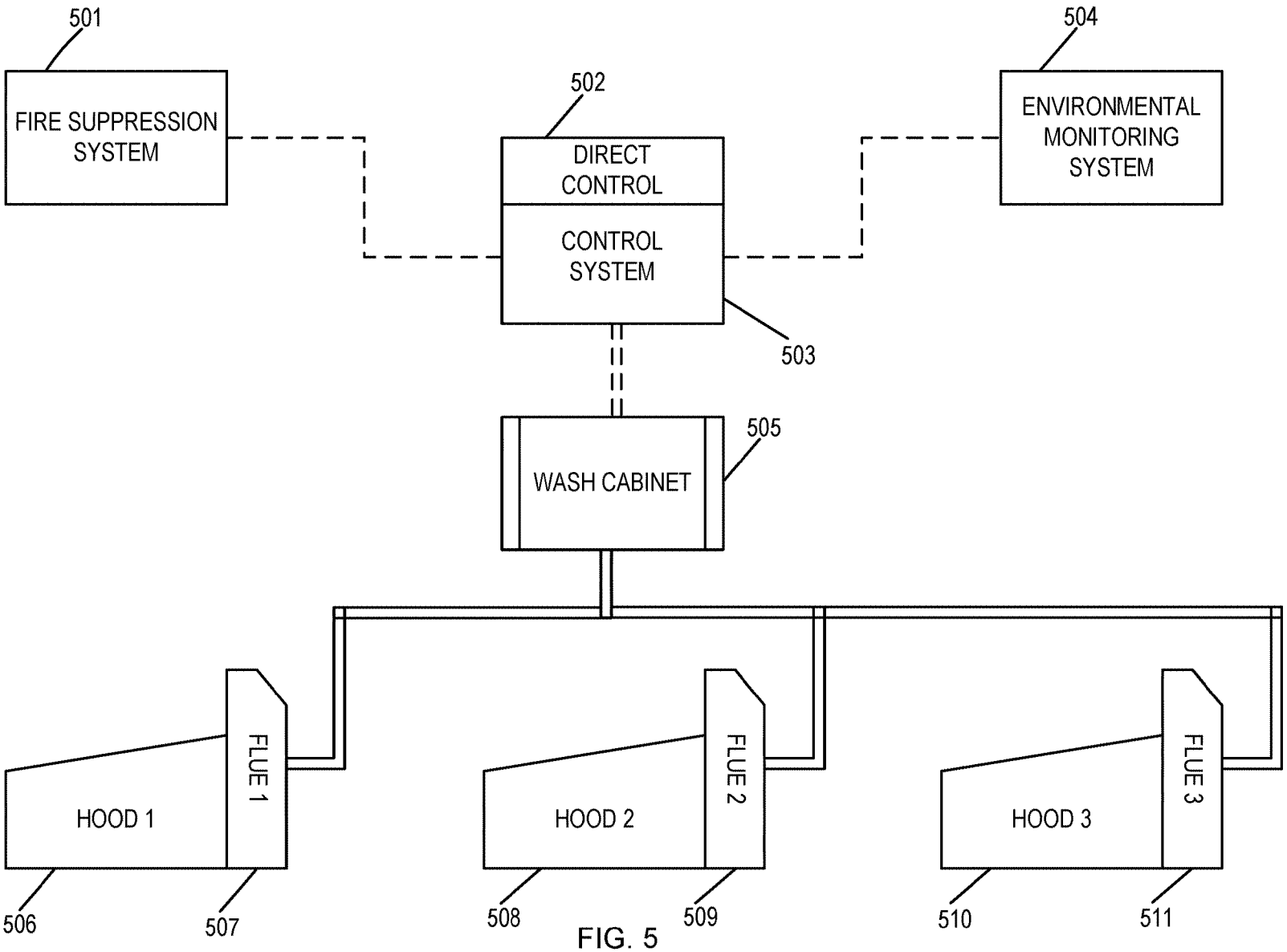
FIG. 5 is a schematic representation of a control system for an exhaust hood cleaning system, according to aspects of the present disclosure.

FIG. 5 is a schematic representation of a control system (or subsystem) for an exhaust hood cleaning system, in operational communication with multiple exhaust hood assemblies. FIG. 5 shows fire suppression system 501, direct control 502, control system 503, environmental monitoring system 504, wash cabinet 505, hood 1 506, flue 1 507, hood 2 508, flue 2 509, hood 3 510, and flue 3 511. It can be appreciated the that control system disclosed herein is a computerized control system, using non-transitory, computer-readable media to send, receive, and transfer information, and to execute instructions that cause o physical components of the overall exhaust hood cleaning system to perform actions.

Generally, the control system can generally have monitoring equipment that works in coordination with sensors in the wash cabinet, exhaust hoods, and flues, where the sensors can include, but are not limited to, temperature sensors, air pressure sensors, water pressure sensors, optic sensors, and the like. These various sensor all feed data back to the control system. other heating and ventilation equipment. The control system can then make fluid flow adjustments via the wash cabinet to control the cleaning cycles for any given exhaust hood and flue combination. Other types or sensors or combinations thereof can also be used as monitoring equipment.

The control system can be further capable of working in concert with the fire suppression systems and/or the environmental monitoring system of the building in which the commercial kitchen and exhaust hood cleaning system are installed. In particular, the control system for the exhaust hood cleaning system can be connected to a building fire suppression system such that when certain fire alarms are triggered, the control system can automatically start or stop water flow though the exhaust hood cleaning system in order to provide water to the exhaust hoods, or to allow for water to be redirected to other areas of the building. Similarly, The control system can have electronically connect to a direct controller interface which can be, for example, a touchscreen control within the commercial kitchen, a remote controller, or an intranet/internet accessible site that can be viewed on a general computer or mobile device. In various embodiments, the control system can receive input from a user, from a dynamic program (responsive to updated inputs or signals), or from an automated program (e.g., a cleaning protocol selected from a set of cleaning protocols), or a combination thereof.

Accordingly, exhaust hood cleaning and washing systems, and controls for such systems, as described herein can include a microprocessor can further be a component of a processing device that controls operation of the imaging instrumentation. The processing device can be communicatively coupled to a non-volatile memory device via a bus. The non-volatile memory device may include any type of memory device that retains stored information when powered off. Non-limiting examples of the memory device include electrically erasable programmable read-only memory ("ROM"), flash memory, or any other type of non-volatile memory. In some aspects, at least some of the memory device can include a non-transitory medium or memory device from which the processing device can read instructions. A non-transitory, computer-readable medium can include electronic, optical, magnetic, or other storage devices capable of providing the processing device with computer-readable instructions or other program code. Non-limiting examples of a non-transitory, computer-readable medium include (but are not limited to) magnetic disk(s), memory chip(s), ROM, random-access memory ("RAM"), an ASIC, a configured processor, optical storage, and/or any other medium from which a computer processor can read instructions. The instructions may include processor-specific instructions generated by a compiler and/or an interpreter from code written in any suitable computer-programming language, including, for example, C, C++, C#, Java, Python, Perl, JavaScript, etc.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate or incremental value falling within the range, or gradients thereof, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. The invention is susceptible to various modifications and alternative constructions, and certain shown exemplary embodiments thereof are shown in the drawings and have been described above in detail. Variations of those preferred embodiments, within the spirit of the present invention, will be apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context. Many other embodiments are possible without deviating from the spirit and scope of the invention. These other embodiments are intended to be included within the scope of the present invention, which is set forth in the following claims.

What is claimed is:

1. An exhaust hood cleaning system, comprising:

a wash cabinet in fluid communication with a hot water source and a cold water source, having a detergent injection system;

a first exhaust hood having a first spraying array subsystem, wherein the first spraying array subsystem includes a first fluid conveyor mounted along a length of the first exhaust hood and a first motor arranged to rotate the first fluid conveyor, wherein the first fluid conveyor has a plurality of first nozzles, and wherein the first spraying array subsystem is in fluid communication with the wash cabinet;

a first ventilation duct having a first fogging subsystem in fluid communication with the wash cabinet, having one or more first misting nozzles;

a second exhaust hood having a second spraying array subsystem, wherein the second spraying array subsystem includes a second fluid conveyor mounted along a length of the second exhaust hood and a second motor arranged to rotate the second fluid conveyor, wherein the second fluid conveyor has a plurality of second nozzles, and wherein the second spraying array subsystem is in fluid communication with the wash cabinet;

a second ventilation duct having a second fogging subsystem in fluid communication with the wash cabinet, having one or more second misting nozzles; and a computer-enabled control system configured to independently control flows of fluids from the wash cabinet to the first spraying array subsystem, the first fogging subsystem, the second spraying array subsystem, and the second fogging subsystem and independently control the first motor and the second motor in order for a first cleaning cycle to be performed on the first exhaust hood, and a second cleaning cycle, different than the first cleaning cycle, to be performed on the second exhaust hood.

2. The system of claim 1, wherein the computer-enabled control system is configured to control the first motor in order to rotate the first fluid conveyor at variable speeds based on a distance of the plurality of first nozzles from a surface of the first exhaust hood.

3. The system of claim 2, wherein the computer-enabled control system is configured to control the first motor in order to rotate the first fluid conveyor at a cycling speed of rotation.

4. The system of claim 1, wherein the first fluid conveyor comprises a plurality of nozzles with elliptical openings.

5. The system of claim 1, wherein the first fluid conveyor comprises a plurality of nozzles that emit a flattened or elliptical cone spray pattern.

6. The system of claim 1, wherein the first fluid conveyor comprises a plurality of nozzles aligned with each other, positioned along a single line.

7. The system of claim 1, wherein the first fluid conveyor comprises a plurality of nozzles arranged such that end areas of elliptical spray cones of sprayed fluid from adjacent nozzles overlap with each other by 5%-10%.

8. The system of claim 1, further comprising sensors located within the exhaust hood and the ventilation duct, wherein the sensors are in operational communication with the control system and are configured to provide measured data to the control system.

9. The system of claim 8, wherein the sensors comprise temperature sensors, air pressure sensors, water pressure sensors, or a combination thereof.

* * * * *